United States Patent [19]

Barbier

[11] Patent Number: 5,014,463

[45] Date of Patent: May 14, 1991

[54] COMBINATION DOOR AND DOOR FRAME

[75] Inventor: Marcel M. Barbier, Herndon, Va.

[73] Assignee: Marcel M. Barbier, Inc., Herndon, Va.

[21] Appl. No.: 489,626

[22] Filed: Mar. 7, 1990

[51] Int. Cl.[5] ..... E05D 7/00

[52] U.S. Cl. ..... 49/401; 49/395; 49/504; 292/202; 292/241

[58] Field of Search ..... 49/400, 401, 381, 395, 49/504, 465, 41; 292/256.6, 44, 54, 46; 52/169.2, 19, 20, 21

[56] References Cited

U.S. PATENT DOCUMENTS

| | | | |
|---|---|---|---|
| 376,010 | 1/1888 | Redline | 52/20 |
| 2,335,450 | 11/1943 | Sandberg | 49/395 |
| 2,850,126 | 9/1958 | Furney | 49/400 |
| 3,159,093 | 12/1964 | Rosenfeld | 49/401 |
| 3,189,951 | 6/1965 | Rosenfeld | 49/401 |
| 3,209,663 | 10/1965 | Baier | 49/395 |
| 3,861,083 | 1/1975 | Goiot | 49/465 |
| 3,987,596 | 10/1976 | Wolf | 49/465 |
| 4,523,407 | 6/1985 | Miller | 49/395 |
| 4,685,249 | 8/1987 | Jacox | 49/395 |

*Primary Examiner*—Gary L. Smith
*Assistant Examiner*—Michael J. Milano
*Attorney, Agent, or Firm*—John C. Smith, Jr.

[57] ABSTRACT

A combination door and door frame primarily designed for blast shelters wherein the hinged door, which in locked position is designed to withstand external overpressures resulting from detonation of either nuclear or conventional weapons, swings inwardly when opened, thus avoiding the objection of outwardly opening doors which can be blocked by rubble, debris, soil, etc. projected by the force of the explosion piling up against the door resulting in the occupants becoming entombed in the shelter.

10 Claims, 2 Drawing Sheets

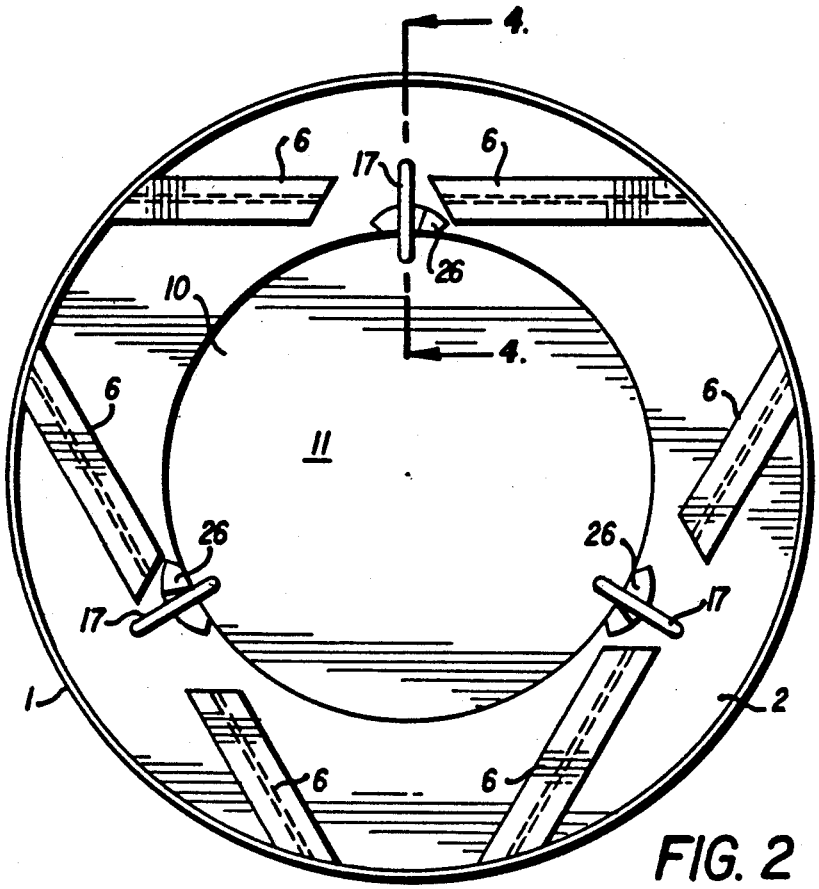
FIG. 2
FIG. 1
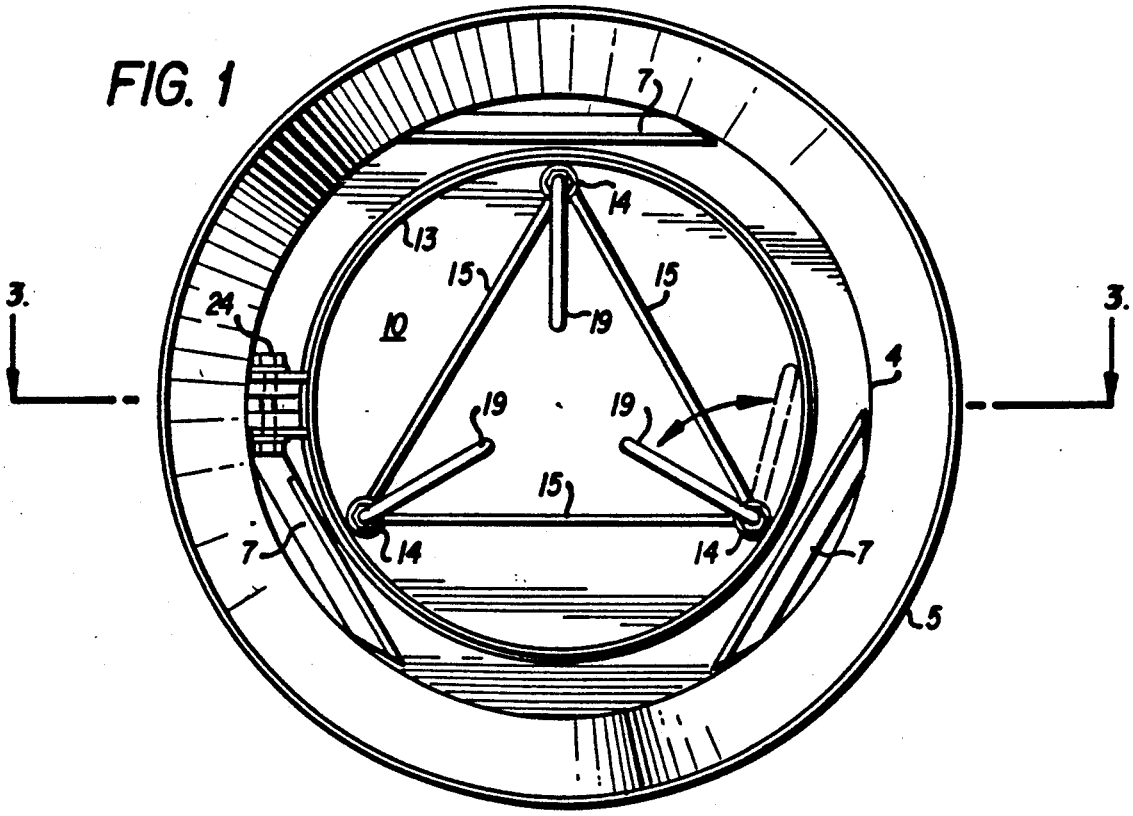

COMBINATION DOOR AND DOOR FRAME

This invention relates to a novel combination door and door frame primarily designed for blast shelters of the type utilized to protect people from the detonation of either nuclear or conventional weapons. The combination door and door frame may be utilized, however, with other ground based structures or with seacraft, aircraft and spacecraft or with pressure tanks, i.e. any structure where external pressures are required to be contained by door means.

BACKGROUND OF THE INVENTION

Presently all blast shelter doors open outwardly, i.e. in the direction of the source of the pressure. This is readily apparent from the abundant commercial literature available. These prior art doors are more easily engineered due to the fact that the external pressure on the door leaf is uniformly distributed over the periphery thereof and accordingly transmitted uniformly to the door frame mounted in a wall of the shelter.

Concern has been raised with respect to prior art blast shelter doors which open outwardly in view of the fact that rubble, debris, soil, etc. can be projected by the force of the explosion against the door and pile up, thereby blocking the door by their own weight and preventing the shelter occupants from opening it. The occupants become entombed inside in the absence of an available emergency exit.

The following prior art U.S. patents, though not exhaustive of the combination door and door frame art, disclose combination doors and door frames of the type described above wherein they open outwardly in the direction of the source of the pressure, i.e. against the overpressure:

U.S. Pat. No. 603,948—Hanlon
U.S. Pat. No. 3,032,835—Saar
U.S. Pat. No. 3,093,098—Rosenfeld
U.S. Pat. No. 3,159,118—Rosenfeld
U.S. Pat. No. 3,585,757—Ritchle et al

SUMMARY OF THE INVENTION

The present invention is concerned with a pressure door opening inwardly, i.e. toward the interior of the structure which interior is to be protected from the external overpressure. The need for a shelter door capable of withstanding overpressure on the outside and at the same time open towards the interior of the structure is obvious. Soil or rubble accumulated outside the door will not prevent opening such a door. Though soil or rubble may slide into the shelter when the door is opened, the occupants would still be able, with shovel and pick, to move the soil and rubble and thereby work their way out of the shelter.

The present invention is further concerned with a pressure door which, though structurally thin, prefabricated and lightweight, will withstand predetermined outside overpressures. The door may be made of metal, plastic, ceramic and/or concrete materials. Though this type of door does not provide substantial shielding against radiation, as heavier concrete doors do, this function can be performed by internal walls carefully placed and adapted to the plan and architecture of the shelter.

Lightweight doors also have the advantage of being more easily transported and lend themselves well to being mounted on the wall of a structure at any angle with respect to the vertical direction, in contrast to concrete doors which are so heavy that they can only be placed vertically.

A further advantage is that the lightweight doors of the present invention can be designed for placement on curved walls and vaults. Moreover, they can be placed, provided they are round, at the end of circular pipes and cylinders.

An object of the present invention is to provide a pressure-resistant combination door and door frame for a shelter in which the door will open inwardly.

A further object of the invention is to provide a pressure-resistant combination door and door frame, the door opening inwardly, which will withstand predetermined external overpressures.

A still further object of the invention is a pressure-resistant combination door and door frame which can be mounted at any angle with respect to the vertical direction.

Another object of the invention is a pressure-resistant combination door and door frame which can be mounted on curved walls and vaults.

A still further object of the invention is to provide a pressure-resistant combination door and door frame which can be mounted on pipes or cylinders.

BRIEF DESCRIPTION OF THE DRAWINGS

The above and other features and objects of the invention will be better understood from the following detailed description of an embodiment of the invention illustrated in the accompanying drawings, in which:

FIG. 1 is a rear view of the combination door and door frame in accordance with the invention;

FIG. 2 is a front view of the combination door and door frame of FIG. 1;

DETAILED DESCRIPTION OF AN EMBODIMENT OF THE INVENTION

Figure 3:
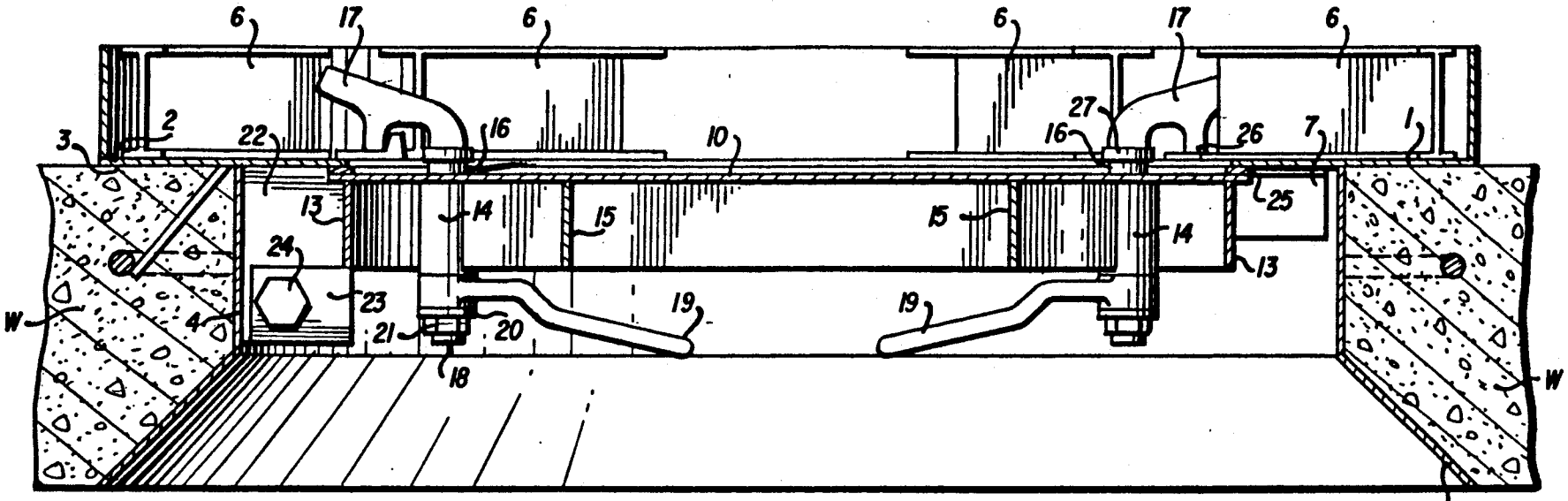
FIG. 3 is a cross-sectional view of the combination door and door frame, mounted in a wall of a shelter, as viewed along the lines 3—3 of FIG. 1.
Figure 4:
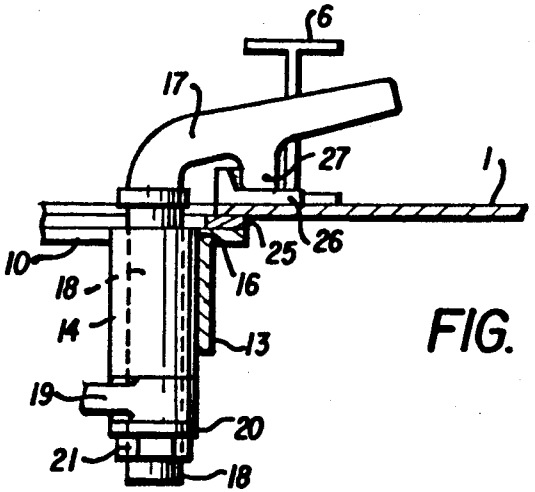
FIG. 4 is a detailed view, partly in cross-section taken along the line 4—4 of FIG. 2.

FIGS. 1 to 4 illustrate in detail one embodiment of the present invention in which the door and door frame are circular. However, other door and door frame shapes, such as elliptical, elongated with parallel opposite sides and semi-circular ends, and polygonal with segments joined by arcs of a circle, may be made utilizing the present invention.

The door frame comprises an annular flat plate 1, having exterior 2 and interior 3 surfaces, a cylindrical frame member 4 projecting from the interior side of the annular plate 1 and a conical member 5 extending from the end of the cylindrical member 4 opposite the plate 1. The exterior side of the plate 1 is reinforced with I beams 6 and on the interior side of the plate by angle members 7. The arrangement of these reinforcing members welded to the annular plate 1 will be described in greater detail below.

As shown in FIG. 3, the door frame is mounted in an opening in a concrete wall W with the annular plate 1 either flush with or extending over the exterior surface of the concrete wall and the free edge of the conical member 5 flush with the interior surface of the concrete wall.

The door comprises a leaf 10 having exterior 11 and interior 12 surfaces and having a circular configuration.

The diameter of the leaf 10 is greater than the inner diameter of the annular plate 1 such that when the door is closed the exterior surface of the leaf 10 adjacent its perimeter overlaps the interior surface 3 of the annular plate 10 adjacent its inner edge.

A reinforcing frame structure is secured to the interior surface 12 of the leaf 10. The frame structure comprises an annular rib 13 adjacent the perimeter of the leaf 1, a plurality of cylinders 14 or block with apertures therein spaced from each other and welded to the interior surface of the annular rib 13 and a plurality of straight ribs 15, each of which extends between adjacent cylinders 14. The ends of the straight ribs 15 are welded to the cylinders 14. The annular rib 13 as well as the straight ribs 15 are all welded along one side to the interior surface 12 of the leaf 10. Holes 16 in the leaf 1 are aligned with the cylinders 14.

Dogs 17 each include a spindle 18 which spindle is rotatable in a cylinder 14. The free end of each spindle 18, which projects beyond the interior end of the respective cylinder 14, has an external square configuration adjacent the interior end of the cylinder, on which is mounted a handle 19, and a helically threaded end for receiving a nut 21 to secure the handle 19 on the spindle 18. A washer 20 is interposed between the nut 21 and the handle 19. Thus, each of the dogs 17 may be rotated from the interior side of the door by a handle 19.

The door is pivotally mounted in the door frame by means of a hinge arrangement. The hinge arrangement comprises a pair of spaced plates 22 (only one shown) secured to the interior surface 3 of the annular plate 1 and the interior surface of the cylindrical frame member 4 and a pair of plates 23 (only one shown) projecting from the exterior side of the annular rib 13 of the door. A bolt 24 passing through plates 22 and plates 23 permits the door to be pivoted on the door frame.

A resilient annular seal 25 is secured either to the interior surface 3 of the annular plate 1 or the exterior surface 11 of the door leaf 10.

To insure that the exterior surface 11 of the door leaf 10 adjacent its perimeter is sealed tightly against the interior surface 3 of the annular plate 1 when the door is locked, wedge members 26 are mounted at appropriate locations on the exterior surface 2 of the annular plate 1 adjacent each of the dogs 17. With the door closed, each of the handles 19 is rotated thereby rotating the respective dog 17 such that the foot portion 27 of the dog 17 contacts and slides along the inclined surface of the wedge member 26. As the dog 17 is rotated by the handle 19 the exterior surface 11 of the leaf 10 is caused to press the annular seal 25 tightly against the interior surface 3 of the annular plate 1 thereby insuring a tight seal between the door and the door frame.

Due to the substantial overpressure to which the exterior surface of the door may be subjected, the annular plate 1 is reinforced by reinforcing members 6 and 7 to distribute throughout the annular plate 1 the high pressure applied by each of the dogs 17 to the wedge members 26 on the exterior surface 2 of the annular plate 1. A pair of I beams 6 are arranged in alignment, but with their ends spaced from each other, on opposite sides of each of the respective wedge members 26. The space between the ends of each pair of I beams 6 is sufficient to permit free rotation of the dog 17. The I beams 6 are arranged along a straight line substantially tangent to the inner edge of the annular plate 1. A reinforcing angular member 7 is secured to the interior surface 3 of the annular plate 1 in alignment with the respective pair of I beams 6 on the exterior surface 2 of the annular plate 1 such that the reinforcing angular member 7 bridges the gap between the ends of the pair of I beams 6 and extends for a substantial length along the adjacent ends of each of the pair of I beams 6. The pressure applied by the dog 17 to the wedge member 26 and the exterior surface 2 of the annular plate 1, is distributed evenly over a substantial portion of the annular plate 1, and consequently to the adjacent portions of the concrete wall, by the combination of the pair of spaced I beams 6 on the exterior surface 2 of the annular plate 1 bridged by the reinforcing angular member 7 on the interior surface 3 of the annular plate 1.

It is to be understood that the form of the invention herewith shown and described is to be considered a preferred example of the same and that various changes in size, shape and arrangement of parts may be resorted to without departing from the spirit of the invention or the scope of the appended claims.

I claim:

1. A combination door and door frame for mounting in an opening in a wall of a structure and adapted to withstand the force of high overpressure on the exterior side thereof, wherein (a) said door frame comprises a perimetrical frame member adapted to line the perimeter of said opening in said wall and a plate member having an opening of predetermined size smaller than the size of said perimetrical frame member and secured to one end of said perimetrical frame member, such that said perimetrical frame member is spaced radially from the perimeter of said opening in said plate member, said plate member projecting transversely from said perimetrical frame member for contacting the exterior surface of said wall surrounding said opening;

(b) said door comprises a leaf having a predetermined size greater than said predetermined size of said opening in said plate member such that when said door is closed the exterior surface of said leaf adjacent the perimeter thereof overlaps the interior surface of said plate member adjacent the entire perimeter of said opening;

(c) a reinforcing frame structure secured to the interior surface of said leaf, said frame structure comprising a perimetrical rib adjacent the perimeter of said leaf and a plurality of further ribs extending across the interior surface of said leaf inside said perimetrical rib;

(d) locking means for securing said door in place in said door frame against said force of said overpressure on the exterior side thereof comprising a plurality of retractable dogs spaced from each other adjacent the periphery of said leaf and projecting from the exterior surface of said leaf for engaging the exterior surface of said plate member of said door frame, and control means connected to each of said dogs and operable from the interior side of said leaf for securing said dogs tightly against said exterior surface of said plate member such that said door is secured in place on said door frame and for releasing and withdrawing said dogs from said exterior surface of said plate member to permit said door to be opened inwardly; and (e) the exterior surface of said plate member of said door frame comprising a plurality of wedge members, each wedge member being adjacent one of said retractable dogs on said leaf of said door;

(f) said locking means comprising a plurality of spindles, each of said retractable dogs being mounted on a spindle and each of said spindles being rotatably mounted in said reinforcing frame structure of said door, a plurality of handles, each handle being attached to the end of a spindle on the interior side of said door, whereby each of said spindles may be manually rotated from the interior side of said door to rotate each of said dogs into contact with the corresponding wedge means on said plate member and secure said door in place on said door frame;

(g) said door frame further comprising a pair of reinforcing frame members on opposite sides of each of said wedges in a line substantially tangent to said opening in said plate member on the exterior surface of said plate member, one end of each of said pair of reinforcing members being adjacent a wedge member and the opposite end of each of said pair of reinforcing members being adjacent the external perimeter of said plate member, and a connecting reinforcing member on the interior surface of said plate member substantially in line with said pair of reinforcing members on said exterior surface of said plate member and overlapping each of said pair of reinforcing members, whereby the pressure applied by each of said dogs to a wedge member and said plate member is distributed throughout said plate member.

2. The combination door and door frame according to claim 1 further comprising hinge means mounted on the interior side of said door frame and on said reinforcing frame of said door to permit said door to pivot inwardly between closed and open positions.

3. A combination door and door frame according to claim 1 further comprising perimetrical, resilient sealing means mounted on one of said plate member and said leaf and positioned such that when said door is secured in place on said door frame said sealing means is disposed between the exterior surface of said leaf adjacent its perimeter and the interior surface of said plate member adjacent the perimeter of said opening therein.

4. A combination door and door frame according to claim 1 wherein said reinforcing frame structure secured to the interior surface of said leaf of said door further comprises a plurality of block means secured at spaced positions to said perimetrical rib, each of said block means defining an aperture therein for rotatably mounting one of said spindles and wherein each of said plurality of further ribs on the interior surface of said leaf extend between said block means with the opposite ends thereof secured to said block means.

5. A combination door and door frame according to claim 1 wherein said perimetrical frame member is cylindrical and said plate member is annular and wherein said leaf and said perimetrical rib of said door are circular.

6. A combination door and door frame for mounting in an opening in a wall of a structure and adapted to withstand the force of high overpressure on the exterior side thereof, wherein (a) said door frame comprises a metrical frame member adapted to line the perimeter of said opening in said wall and a planar, perimetrical plate member having interior and exterior surfaces and a perimeter size greater than the size of said frame member and an opening therein of predetermined size smaller than the size of said perimetrical frame member, the external edge of said plate member being at its perimeter and the internal edge of said plate member surrounding said opening, one end of said perimetrical frame member being secured to the interior surface of said perimetrical plate member intermediate its internal and external edges such that said perimetrical plate member extends transversely with respect to said perimetrical frame member both inwardly to said opening and outwardly for contacting the exterior surface of said wall surrounding said opening;

(b) said door comprises a leaf having interior and exterior surfaces and having a predetermined size greater than said predetermined size of said opening in said plate member such that when said door is closed the exterior surface of said leaf adjacent the perimeter thereof overlaps the interior surface of said plate member adjacent the entire internal edge of said plate member;

(c) a reinforcing frame structure secured to the interior surface of said leaf, said frame structure comprising a perimetrical rib adjacent the perimeter of said leaf and a plurality of further ribs extending across the interior surface of said leaf inside said perimetrical rib; and (d) locking means for securing said door in place in said door frame against said force of said overpressure on the exterior surface thereof comprising a plurality of retractable dogs spaced from each other adjacent the periphery of said leaf and projecting from the exterior surface of said leaf for engaging the exterior surface of said plate member of said door frame, and control means connected to each of said dogs and operable from the interior side of said leaf for securing said dogs tightly against said exterior surface of said plate member such that said door is secured in place on said door frame and for releasing and withdrawing said dogs from said exterior surface of said late member to permit said door to be opened inwardly.

7. The combination door and door frame according to claim 6 wherein the exterior surface of said plate member of said door frame comprises a plurality of wedge members, each wedge member being adjacent one of said retractable dogs on said leaf of said door; and said locking means comprises a plurality of spindles, each of said retractable interior surface of said plate member adjacent the perimeter of said opening therein.

8. The combination door and door frame according to claim 6 further comprising hinge means mounted on said perimetrical frame member and on said reinforcing frame of said door to permit said door to pivot inwardly between closed and open positions.

9. A combination door and door frame according to claim 7 wherein said door frame further comprises elongated reinforcing means secured to at least one of said interior and exterior surfaces of said perimetrical plate member in substantial alignment with each of said wedge members and extending substantially tangent to said opening in said plate member whereby the pressure applied by each of said dogs to a wedge member and said plate member is distributed throughout said plate member.

10. A combination door and door frame for mounting in an opening in a wall of a structure and adapted to withstand the force of high overpressure on the exterior side thereof, wherein (a) said door frame comprises a perimetrical frame member adapted to line the perimeter of said opening in said wall and a plate member having an opening of predetermined size smaller than the size of said perimetrical frame member and secured to one end of said perimetrical frame member, such that said perimetrical frame member is spaced radially from the perimeter of said opening in said plate member, said plate member projecting transverse from said perimetrical frame member for contacting the exterior surface of said wall surrounding said opening;

(b) said door comprises a leaf having a predetermined size greater than said predetermined size of said opening in said plate member such that when said door is closed the exterior surface of said leaf adjacent the perimeter thereof overlaps the interior surface of said plate member adjacent the entire perimeter of said opening;

(c) a reinforcing frame structure secured to the interior surface of said leaf, said frame structure comprising a perimetrical rib adjacent the perimeter of said leaf and a plurality of further ribs extending across the interior surface of said leaf inside said perimetrical rib;

(d) locking means for securing said door in place in said door frame against said force of said overpressure on the exterior side thereof comprising a plurality of retractable dogs spaced from each other adjacent the periphery of said leaf and projecting from the exterior surface of said leaf for engaging the exterior surface of said plate member of said door frame, and control means connected to each of said dogs and operable from the interior side of said leaf for securing said digs tightly against said exterior surface of said plate member such that said door is secured in place on said door frame and for releasing and withdrawing said dogs from said exterior surface of said plate member to permit said door to be opened inwardly;

(e) the exterior surface of said plate member of said door frame comprising a plurality of wedge members, each wedge member being adjacent one of said retractable dogs on said leaf of said door; and (f) said door frame further comprising elongated reinforcing means secured to at least one of the interior and exterior surfaces of said perimetrical plate member in substantial alignment with each of said wedge members and extending substantially tangent to said opening in said plate member whereby the pressure applied by each of said dogs to a wedge member and said plate member is distributed throughout said plate member.

* * * * *